US006428283B1

(12) United States Patent
Bonior

(10) Patent No.: US 6,428,283 B1
(45) Date of Patent: Aug. 6, 2002

(54) SPA MOTOR COOLING METHOD AND APPARATUS

(75) Inventor: David Bonior, Langley (CA)

(73) Assignee: 513004 B.C. Ltd., Surrey (CA)

( * ) Notice: Subject to any disclaimer, the term of this patent is extended or adjusted under 35 U.S.C. 154(b) by 0 days.

(21) Appl. No.: 09/397,485

(22) Filed: Sep. 16, 1999

(51) Int. Cl.[7] ..... F09B 23/14; F09B 35/04
(52) U.S. Cl. ..... 417/201; 417/423.8
(58) Field of Search ..... 417/199.1, 201, 417/203, 423.8

(56) References Cited

U.S. PATENT DOCUMENTS 3,229,896 A * 1/1966 Levy ..... 417/203
4,858,255 A 8/1989 Haisman
5,156,535 A * 10/1992 Budris et al. ..... 417/423.7
5,375,651 A * 12/1994 Colwell ..... 417/423.7
5,431,548 A * 7/1995 Koble, Jr. ..... 417/423.8
5,548,100 A * 8/1996 Miller ..... 219/521
5,555,648 A * 9/1996 Griffin ..... 24/621
5,647,736 A 7/1997 French
5,807,289 A 9/1998 Camp
5,893,180 A 4/1999 Moreland
5,924,850 A * 7/1999 French ..... 417/423.8

* cited by examiner

*Primary Examiner*—Charles G. Freay
(74) *Attorney, Agent, or Firm*—John Russell Uren

(57) ABSTRACT

Water circulation apparatus for use in a spa or the like utilises a turbine or axial flow pump for pumping the water from a water inlet to the jets or other exhaust openings within the spa and under the water surface. Cooling air from ambient surroundings is used to cool a motor providing power to the pump. The motor and pump are located within a component compartment and exhaust openings exhaust the cooling air passing through the motor where it may be used for heating towels. The component compartment may be sealed thereby to allow heated air to escape only from the exhaust openings.

13 Claims, 4 Drawing Sheets

SPA MOTOR COOLING METHOD AND APPARATUS

INTRODUCTION

This invention relates to spas, hot tubs, bathtubs and the like and, more particularly, to the use of an axial flow or turbine pump to circulate water under pressure to the spa jets and, further, to a cooling system used for cooling the electric motor driving the turbine pump.

BACKGROUND OF THE INVENTION

The use of pumps in spas, hot tubs, bathtubs and the like is, of course, well known. Such pumps are used to receive water from a water inlet, place the water under pressure and convey such water to the various outlets or jets within the spa enclosure where the user is or is intended to be positioned. The water exiting the jets creates a flow within the water of the spa and exhausts on the user, if so desired. The water has a pleasant and therapeutic benefit.

The pumps that create the pressure and provide water to the jets within the spa, however, are centripetal type pumps. These pumps have an impeller with a central portion into which water from a water inlet is introduced. The impeller has a series of radially located vanes that conveys the water radially outwardly from the central inlet area to an outlet located adjacent the radial vanes. While such centripetal type pumps are pervasive in the industry, they have disadvantages.

A first disadvantage is that the water volume supplied under pressure by the centripetal type pump is limited. This dictates the size of jets that can be used in order to impinge properly upon a user and to create the desired currents within the tub. Second, with the use of a centripetal type pump, the operation is typically at the upper end of the pump volume capabilities. This causes high pump noise which is diversionary to the enjoyment of the spa. Thirdly, since the volume of water being pumped is limited, the jets may emit less water than would otherwise be desirable for optimum performance. Fourthly, to provide the necessary pressure on the user with the limited volume of water moved by the centripetal pump and exiting from the jets, the volume of water may need to be concentrated; that is, it is emitted from a smaller area. This narrow water jet then impinges over a limited area on the user which can make the spa use uncomfortable.

U.S. Pat. No. 5,647,736 (French) teaches a motor cooling technique typically used in spas. French takes air from within the component compartment of the spa and passes such air through the motor which powers the spa pump by using the cooling fan within the motor. French teaches collecting the hot air which has passed through the motor by an exhaust shroud and exhausting such air to ambient conditions outside the component compartment of the spa.

While the technique taught by the '736 patent is generally satisfactory, advantages in such cooling techniques and increased flexibility in using the cooling air are possible. First, because French takes his cooling air from within the component compartment, which component compartment is the location of electrical and electronic components which generate heat, the air gathered from the component compartment by French is at a relatively elevated temperature which prejudices the motor cooling effect. Superior cooling with air at a lower temperature would be useful.

Second, by exhausting his collected and heated air to a location outside the spa, the thermal energy of the heated air dissipated in the atmosphere is wasted by French. It would be useful if the thermal energy of the heated air could be applied to other uses.

Third, motors used to power centripetal type pumps typically do not have wide operating environment capabilities. They are prone to overheating if used in adverse conditions such as high altitude, low humidity and high ambient temperature conditions. Likewise, if the ventilation surrounding the motor is poor such as would be the case when the pump and motor are located under the skirt of the spa, overheating and premature failure can result.

SUMMARY OF THE INVENTION

According to one aspect of the invention, there is provided water circulation apparatus for use in a water holding enclosure such as a spa, bathtub and the like, said apparatus comprising a water inlet, at least one water outlet operably connected to said water inlet and being operable to exhaust water under pressure passing from said water inlet to said water outlet and a pump for pumping said water received from said water inlet to said water outlet, said pump being an axial flow pump.

According to a further aspect of the invention, there is provided a method for providing water under pressure to at least one water outlet opening in a water holding enclosure such as a spa, bathtub and the like, said method comprising conveying said water under pressure from a water inlet to said water outlet opening by an axial flow pump located between said water inlet and said water outlet opening.

According to yet a further aspect of the invention, there is provided cooling apparatus for cooling the motor of a water pump, said motor having windings, said cooling apparatus comprising an air inlet member for obtaining cooling air from ambient surroundings and passing said cooling air to said motor, a duct to allow said cooling air to pass from said air inlet member to said motor, a fan within said motor to convey said cooling air from said duct through said motor and over said windings, an exhaust outlet in said motor to allow said cooling air to exhaust from said motor and at least one exhaust grid to allow said air conveyed from said exhaust outlet of said motor to exhaust to said ambient air.

According to still yet a further aspect of the invention, there is provided a method of cooling a motor used for driving a pump in a spa, bathtub and the like, said method comprising conveying cooling air from ambient surroundings through a duct to said motor, passing said cooling air from said duct through said motor, exhausting said cooling air from said motor and allowing said cooling air exhausted from said motor to exhaust from an air outlet grid to said ambient surroundings.

According to still yet a further aspect of the invention, there is provided a pump for pumping water in a spa, bathtub and the like, said pump being driven by a motor having an inside and an outside and windings, an air inlet to obtain cooling air from ambient surroundings, a duct to convey said cooling air to said motor, a fan to convey said cooling air over said windings, an exhaust outlet to exhaust said cooling air from said motor, and a shroud adjacent said exhaust outlet, said shroud being shaped to direct said cooling air back over said outside of said motor.

According to still yet a further aspect of the invention, there is provided a method for cooling a pump motor in a spa, bathtub and the like, said pump motor having an inside and an outside, said method comprising the steps of conveying cooling air from ambient surroundings through a duct to an air inlet of said pump motor, passing said cooling air through said inside of said motor, exhausting said cooling air from an exhaust opening in said pump motor and directing said cooling air back over said outside of said motor by a shroud located adjacent said exhaust opening of said pump motor.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1:
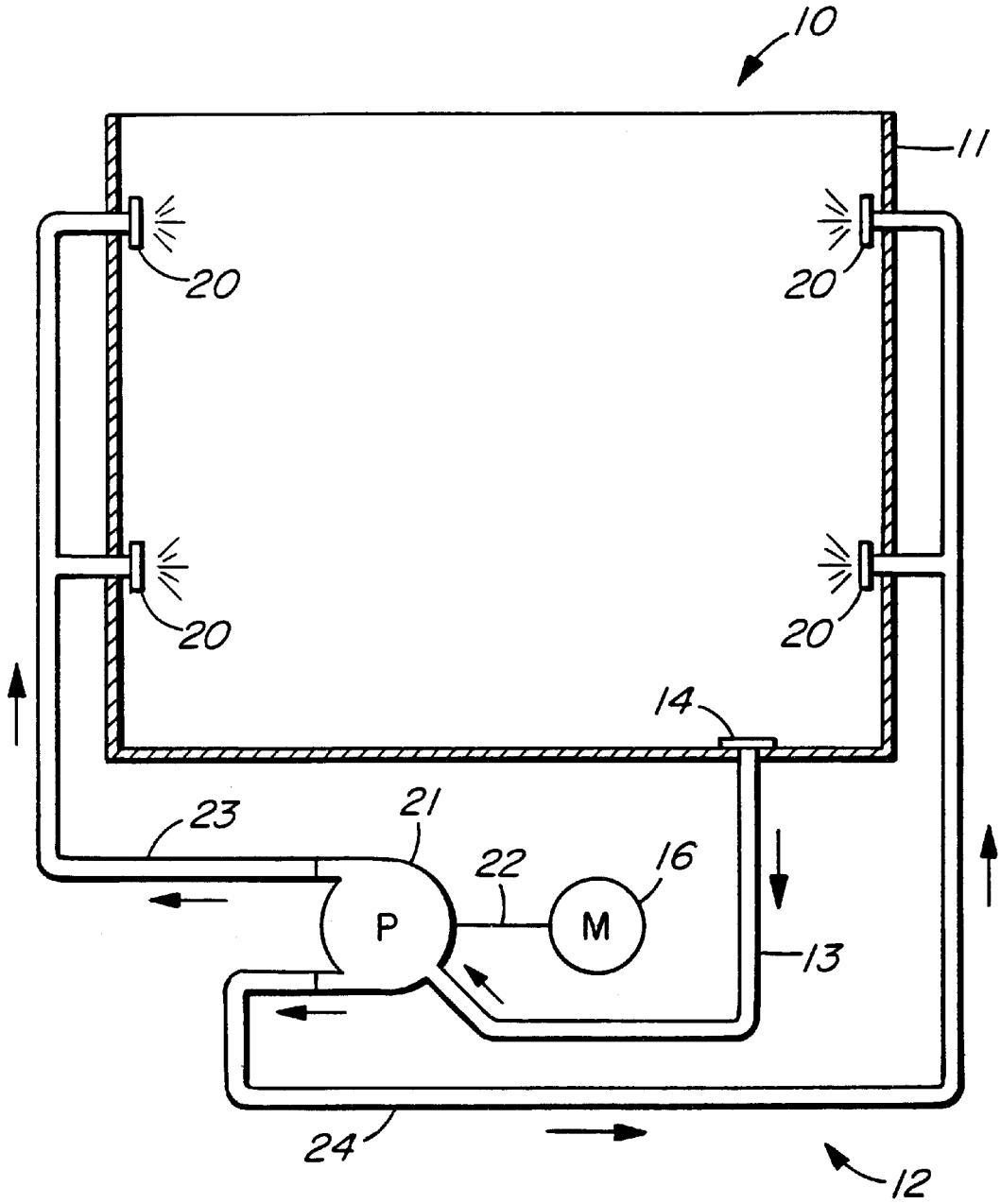
FIG. 1 is a diagrammatic plan view illustrating the motor and axial flow or turbine pump of a spa according to a first embodiment of the present invention.

Referring now to the drawings, a spa, hot tub, bathtub and the like is generally illustrated at 10 in FIG. 1. The spa 10 includes a tub or enclosure 11 for holding water into which a user is ordinarily immersed while in operation and a water circulation system generally illustrated at 12.

The water circulation system includes a water inlet pipe 13 which is generally attached to an inlet grill 14 located under the surface of the water in the enclosure 11 such that the water within the spa 10 is constantly recirculated from the inlet grill 14 to the water jets 20, which jets 20 are likewise located within the tub enclosure 11 and under the water surface. Jets 20 are used to create currents within the tub 11 and to provide water under pressure to the body of a user as desired and as, of course, is known.

The water circulation system 12 further comprises a motor 16 used for driving a pump 21 by way of shaft 22. The pump 21 is a turbine or axial flow pump as will be described in greater detail. An axial flow or turbine pump has a configuration in which the water leaves the pump though a pathway or pathways which are generally parallel to the water ingress pathway. Two outlet pipes 23, 24 extend from the turbine pump 21 and are each connected to a proportionate number of jets 20. In accordance with FIG. 1, each of the outlet pipes 23, 24 is conveniently connected to two(2) jets 20.

Figure 2:
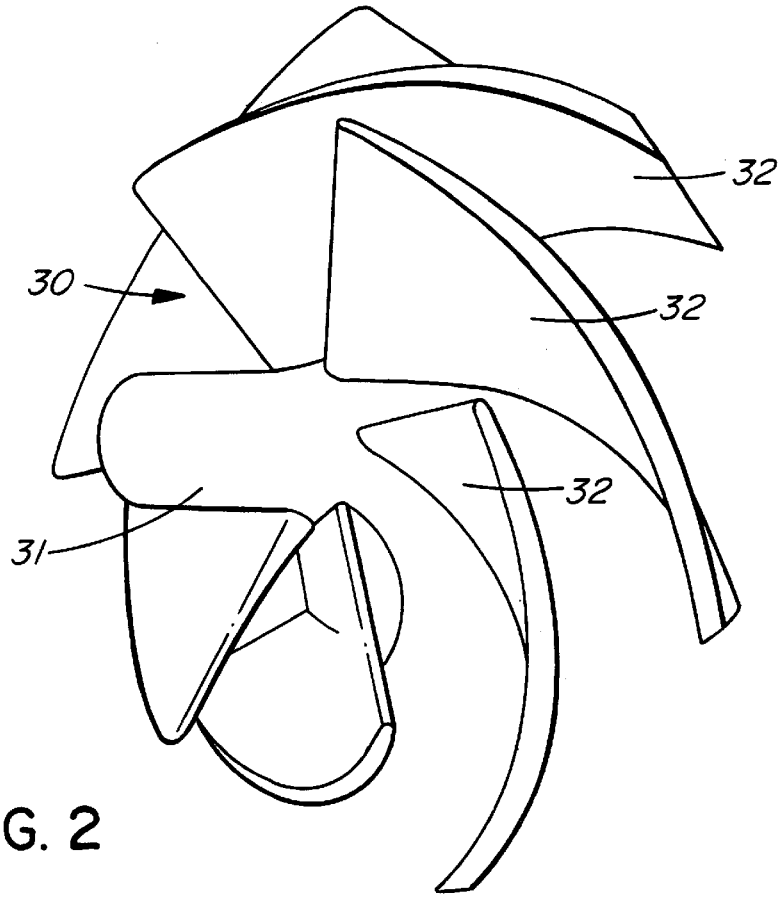
FIG. 2 is a diagrammatic isometric view of the impeller used in the axial flow pump according to the invention particularly illustrating the hub and blade surfaces.

The turbine or axial flow pump 21 includes an impeller generally illustrated at 30 (FIG. 2) with a plurality of blades 32 located about the periphery of the impeller 30. One of the blades 32 is illustrated diagrammatically in FIG. 4. The impeller 30 further comprises a hub 31 which rotates together with the blades 32 by way of shaft 22 which shaft 22 is connected to motor 16 (FIGS. 1 and 4) as has been described.

Figure 4:
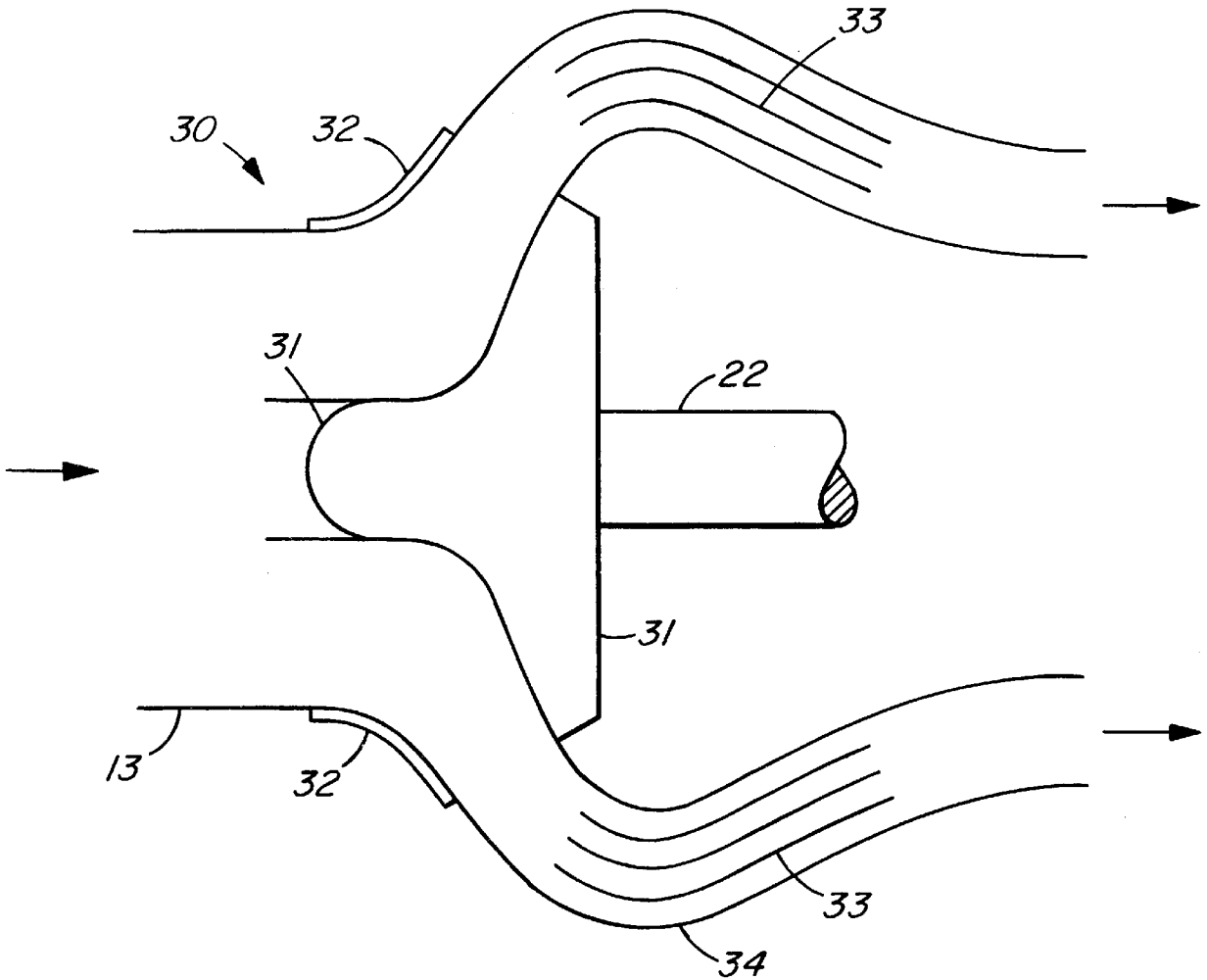
FIG. 4 is a diagrammatic side view in cutaway illustrating the hub and one impeller vane of the turbine pump and, further, illustrating deswirl vanes located downstream of the pump impeller.

Deswirl vanes 33, conveniently machined into the water pathways 33, 34, to straighten the water flow exiting from the pump 21 are diagrammatically illustrated in FIG. 4. The deswirl vanes 33 are located downstream of the impeller 30. Deswirl vanes 33 smooth the flow and bring the water in water pathways 34 radially inwardly and connect the water pathways 34 to axial outflow pipes 23, 24 (FIG. 1). Axial outflow pipes 23, 24 extend to jets 20 as previously described.

OPERATION

Figure 3:
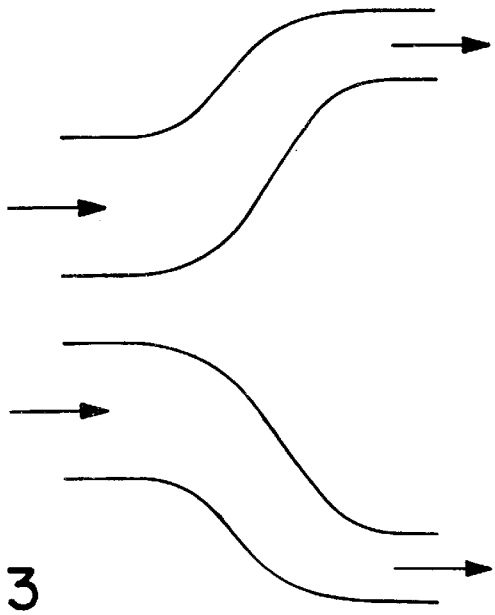
FIG. 3 is a diagrammatic isometric view of the flow path downstream from the pump blades, also known as a meridional profile view of the axial flow pump.

In operation, the spa 10 will be filled with water as is known and the operation of the motor 16 will be initiated by turning a switch on or otherwise commencing its operation. Shaft 22 will commence to turn impeller 30 (FIG. 3) and hub 31 with blades 32 attached thereto. Water coming from the inlet pipe 13 will be put under pressure and propelled by the blades 32 to water pathways 34 connected to the downstream side of impeller 30. The deswirl vanes 33 will allow removal of turbulence and smoothly pass the water to outlet pipes 23, 24 where the water under pressure passes to the jets 20. The water exiting from jets 20 will pass to the tub enclosure 11 where it creates currents in the tub 11 and, if desired, is directed by the jets 20 onto the body of a user.

Figure 5:
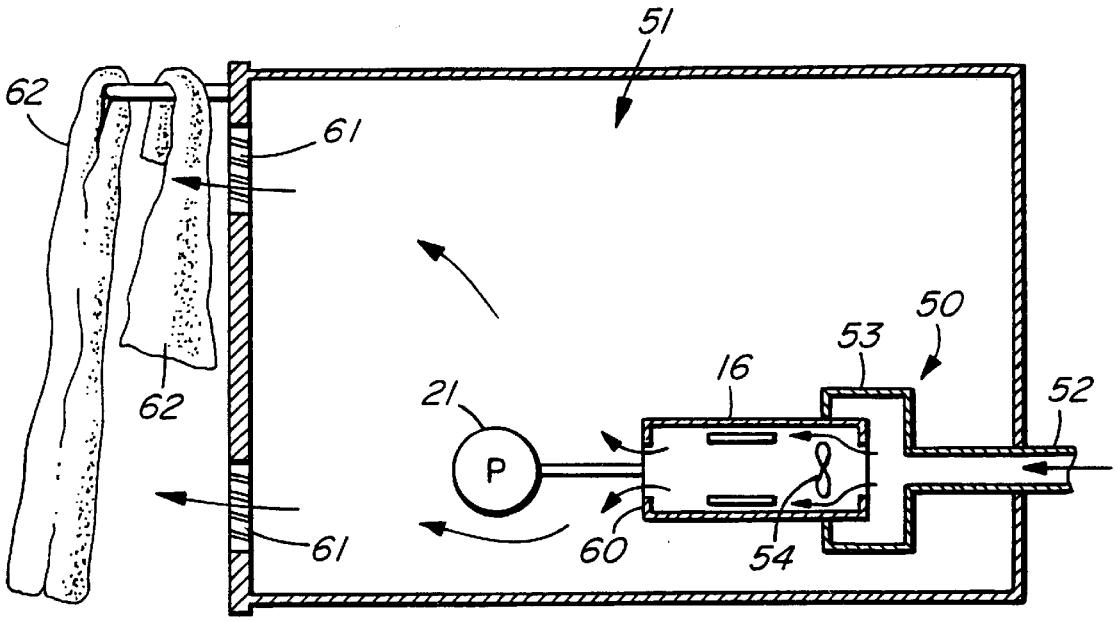
FIG. 5 is a diagrammatic side view of the cooling air system used for motor cooling according to a further aspect of the invention.

The cooling system for the motor 16 driving pump 21 is generally illustrated at 50 in FIG. 5. The pump 21 and motor 16 are each located within the component compartment generally illustrated at 51 of the spa 10. Component compartment 51 includes most of the operating components of the spa 10 and particularly includes the electrical and electronic components such as motor 16, solenoids (not shown), logic components (not shown), all of which generate heat during operation. The component compartment 51 is conveniently sealed, as will be described, with the exception of exit vents 61 so that air introduced into the component compartment 51 may be directed from the exit vents 61 as desired.

An air inlet pipe 52 allows air to be obtained from the ambient surroundings where the spa 10 is located. It will be appreciated that spas 10 are typically used more often when the ambient air is considerably cooler that the water temperature of the spa 10. Generally, therefore, the ambient air will be relatively cool compared to the temperature of the air within the component compartment 51.

The ambient air enters air inlet pipe 52 and passes to a shroud 53 connected to motor 16. A fan 54 conveys air from the air inlet pipe 52 and passes it over the windings within the motor 16. Since the windings of motor 16 are generating heat, the air will be heated as it flows from the downstream end of motor 16 to the upstream end 60. The heated air leaves the upstream end of motor 16 and may, if desired, pass over pump 21 by ducting or otherwise.

Two(2) air exit grills 61 are positioned on the outside of the component compartment 51 in a location convenient for hanging towels 62, bathing suits (not shown) and the like. The heated air from the component compartment 51 will warm the towels 62 with the use of the thermal energy carried by the heated air which will then pass to the ambient surroundings.

In preliminary design models of the turbine pump 21, calculations show that an impeller 30 having five(5), six(6) or seven(7) blades would be satisfactory. An energy requirement to drive the pump 21 of approximately 2600 watts would produce a volume flow of approximately 400 gallons per minute under load which would require approximately 15 amps at 220 volts to drive motor 16. The head or pressure rise of the water through the pump 21 is calculated to be approximately eighteen(18) psi. The design of the deswirl vanes 33 (FIG. 4) has yet to be completed and, indeed, design calculations relating to the final design of the deswirl vanes 33 have not yet commenced. It is to be emphasized that the final design of the apparatus has not yet been completed and that the specifications given above are for the purpose of full disclosure at the date of this application. Subsequent design specifications will undoubtedly change under operating conditions with and when actual prototype apparatuses are developed.

Figure 6:
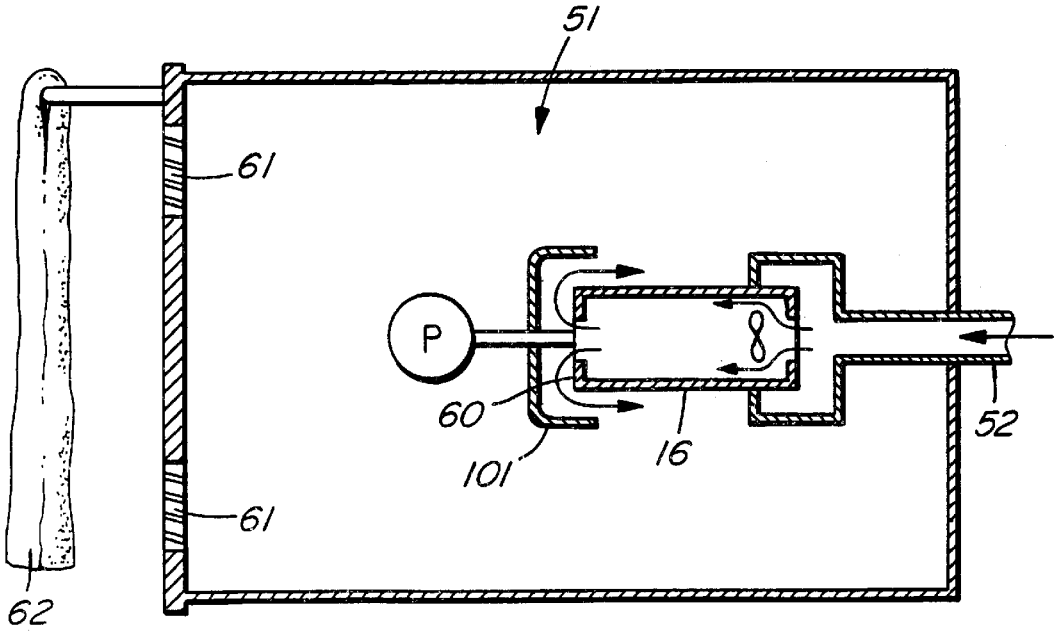
FIG. 6 is a diagrammatic side view of the cooling air system used for the motor similar to FIG. 5 according to a further aspect of the invention.

Yet a further embodiment of the invention is illustrated in FIG. 6. This embodiment resembles the FIG. 5 embodiment but whereas the air exhausting from motor 16 in FIG. 5 simply exits into the component compartment 51, the FIG. 6 embodiment includes a shroud 101 which is positioned adjacent the exhaust outlet 60 of motor 16 and which is shaped so as to redirect the air back over the outside of motor 16 thereby to further increase the cooling of motor 16 after leaving from the inside of motor 16.

Many modifications will readily occur to those skilled in the art to which the invention relates. For example, while the invention has been described as used in association with spas, hot tubs and the like, it is intended that such use would extend to bathtubs, swimming pools and pools where users swim against a current generated by water pumping action. Likewise, while a single stage axial flow or turbine pump 21 has been described, it is contemplated that a two stage turbine pump might also be useful under various operating conditions and/or for different applications. In a two stage turbine pump, the water being pumped and leaving the first stage enters the second stage of the pump to be further pressurized.

Many other modifications will arise, therefore, the specific embodiments described should be taken as illustrative of the invention only and not as limiting its scope as defined in accordance with the accompanying claims.

I claim:

1. Cooling apparatus for cooling the motor of a water pump within a motor compartment, said motor having windings, said cooling apparatus comprising an air inlet member for obtaining cooling air from a source of relatively cooler air outside said motor compartment and passing said cooling air to said motor through a duct extending from said air inlet member outside said engine compartment to said motor, a fan within said motor to convey said cooling air from said duct through said motor and over said windings, an exhaust outlet from said motor to allow said cooling air to exhaust from said motor and at least one vent member to allow said cooling air conveyed from said exhaust outlet of said motor to exhaust to said ambient surroundings.

2. Cooling apparatus as in claim 1 wherein said motor and said pump are positioned within a component compartment.

3. Cooling apparatus as in claim 1 wherein said exhaust grid has a towel mounting member located adjacent thereto.

4. Cooling apparatus as in claim 2 wherein said component compartment is sealed, said exhaust grid allowing exit of air from said component compartment.

5. Cooling apparatus as in claim 4 and further comprising a shroud between said duct and said motor to allow all of said cooling air from said duct to pass through said motor.

6. Cooling apparatus as in claim 5 wherein said cooling air from said motor is passed over said pump.

7. Method of cooling a motor within a motor compartment which motor is used for driving a pump in a spa, bathtub and the like, said method comprising conveying cooling air from ambient surroundings outside said motor compartment through a duct extending from said outside of said motor compartment to said motor, passing said cooling air received from said duct through said motor, exhausting said cooling air from said motor and passing said cooling air exhausted from said motor through a vent between said motor compartment and said ambient surroundings.

8. Method of cooling as in claim 7 and further comprising positioning said motor and pump within a component compartment.

9. Method of cooling as in claim 8 and further comprising sealing said component compartment to allow air to exit from said component compartment from said air outlet grid.

10. Method of cooling as in claim 9 and further comprising raising the temperature of fabric positioned adjacent said air outlet grid.

11. Method of cooling as in claim 10 wherein said fabric is a towel.

12. Pump for pumping water in a spa, bathtub and the like, said pump being driven by a motor having an inside and an outside and windings, an air inlet to obtain cooling air from ambient surroundings, a duct to convey said cooling air to said motor, a fan to convey said cooling air over said windings, an exhaust outlet to exhaust said cooling air from said motor, and a shroud adjacent said exhaust outlet and shaped to direct said cooling air back over said outside of said motor.

13. Method for cooling a pump motor in a spa, bathtub and the like, said pump motor having an inside and an outside, said method comprising the steps of conveying cooling air from ambient surroundings through a duct to an air inlet of said pump motor, passing said cooling air through said inside of said motor, exhausting said cooling air from an exhaust opening in said pump motor and directing said cooling air back over said outside of said motor by a shroud located adjacent said exhaust opening for said pump motor.

* * * * *